US007062948B2

(12) United States Patent
Beagle

(10) Patent No.: US 7,062,948 B2
(45) Date of Patent: Jun. 20, 2006

(54) PROCESS OF END-FORMING A TUBE HAVING INTERNAL SURFACE FEATURES

(75) Inventor: Gerald Richard Beagle, Blissfield, MI (US)

(73) Assignee: Blissfield Manufacturing Company, Blissfield, MI (US)

( * ) Notice: Subject to any disclaimer, the term of this patent is extended or adjusted under 35 U.S.C. 154(b) by 270 days.

(21) Appl. No.: 10/605,280

(22) Filed: Sep. 19, 2003

(65) Prior Publication Data

US 2004/0112113 A1 Jun. 17, 2004

Related U.S. Application Data

(60) Provisional application No. 60/319,561, filed on Sep. 19, 2002.

(51) Int. Cl.
*B21D 41/04* (2006.01)

(52) U.S. Cl. ..... 72/370.02; 72/370.01; 72/370.03; 72/370.24; 72/370.25

(58) Field of Classification Search ..... 72/370.02, 72/370.03, 370.1, 370.23, 370.24, 370.25, 72/391.2

See application file for complete search history.

(56) References Cited

U.S. PATENT DOCUMENTS 4,457,157 A * 7/1984 Masaki et al. ..... 72/352
4,934,038 A * 6/1990 Caudill ..... 29/523
6,155,092 A * 12/2000 Sahlem ..... 72/260

FOREIGN PATENT DOCUMENTS

| | | | |
|---|---|---|---|
| DE | 383516 | | 7/1989 |
| EP | 0188086 | A2 * | 9/1985 |
| EP | 0188086 | | 7/1986 |
| EP | 0188086 | A2 * | 7/1986 |
| JP | 07124668 | * | 10/1993 |
| JP | 07124668 | | 5/1995 |

* cited by examiner

*Primary Examiner*—Derris H. Banks
*Assistant Examiner*—Debra M Wolfe
(74) *Attorney, Agent, or Firm*—Gary M. Hartman; Domenica N. S. Hartman; Hartman & Hartman

(57) ABSTRACT

A process by which the end of a tube having at least one internal surface feature is reduced and at least a portion of the surface feature eliminated from the tube end while achieving accurate control of the outer diameter of the tube end. The process preferably makes use of a forming tool comprising an external die for reducing the outer diameter of a tube and a mandrel for deforming the internal passage of the tube. The process generally comprises forcing the external die over the end of the tube so that the outer diameter of the tube end is reduced and so that the mandrel is simultaneously inserted through the internal passage of the tube end. While the tube end remains within the external die, the mandrel is withdrawn from the internal passage of the tube end to eliminate the internal surface feature.

20 Claims, 2 Drawing Sheets

PROCESS OF END-FORMING A TUBE HAVING INTERNAL SURFACE FEATURES

CROSS REFERENCE TO RELATED APPLICATIONS

This application claims the benefit of U.S. Provisional Application No. 60/319,561, filed Sep. 19, 2002.

BACKGROUND OF INVENTION

1. Field of the Invention

The present invention generally relates to processes for forming the end of a tube in which internal surface features are present. More particularly, this invention relates to a process by which the end of such a tube can be reduced and the surface features removed during an end-forming operation while achieving accurate control of the tube outer diameter.

2. Description of the Related Art

Tubes for cooling equipment are often formed to have internal surface features in the form enhancements, which may be described as flutes, ribs, etc., that are present on the internal circumference of the tube to promote heat transfer. Such a tube 10 is represented in FIGS. 3 and 4, in which the latter is a cross-sectional view of the tube 10 showing internal flutes 12 projecting radially inward from the internal circumference 14 of the tube 10. Internal enhancements of the type shown in FIGS. 3 and 4, are typically formed during drawing of the tube 10, and are therefore present along the entire tube length.

In the situation depicted in FIG. 3 in which the tube end 16 is required to undergo an end-forming operation to reduce its diameter, the flutes 12 can interfere with the reduction process and excessively restrict flow through the tube end 16. Therefore, flutes 12 and other internal enhancements are often removed, such as by machining. However, the additional machining step and resulting possible contamination from chips are undesirable. An alternative approach is to remove the flutes 12 during the end-forming operation by using a die to reduce the outer diameter (OD) of the tube, after which the OD die is removed and an inner diameter (ID) mandrel is passed through the reduced portion of the tube. A disadvantage with this approach is that the mandrel can alter the OD of the tube 10, making it difficult to obtain or control the OD of the tube 10.

SUMMARY OF INVENTION

The present invention provides a process by which the end of a tube having at least one internal surface feature can be reduced and at least a portion of the surface feature eliminated from the tube end during an end-forming operation while achieving accurate control of the tube outer diameter. The process preferably makes use of a forming tool comprising an external die for reducing the outer diameter of a tube and a mandrel for deforming the internal passage of the tube. The process of this invention generally comprises the steps of forcing the external die over the end of the tube so that the outer diameter of the tube end is reduced and so that the mandrel is simultaneously inserted through the internal passage of the tube end, during which time the mandrel is positioned farther within the tube than the portion of the tube end reduced by the external die. While the tube end remains within the external die, the mandrel is withdrawn from the internal passage of the tube end to eliminate the internal surface feature, preferably by deformation without physically removing the material defining the internal surface feature. Because the tube end remains within the external die during elimination of the internal surface feature, the desired outer diameter of the tube can be maintained.

Other objects and advantages of this invention will be better appreciated from the following detailed description.

DETAILED DESCRIPTION

Figure 1:
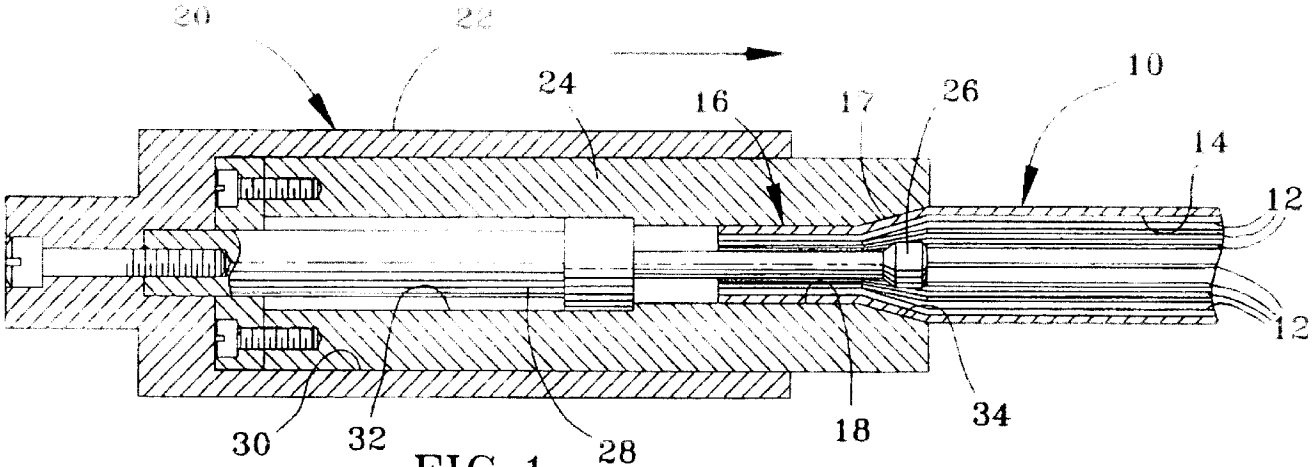
FIGS. 1 and 2 represent steps in a process for end-forming a tube having a fluted internal diameter in accordance with this invention.
Figure 2:
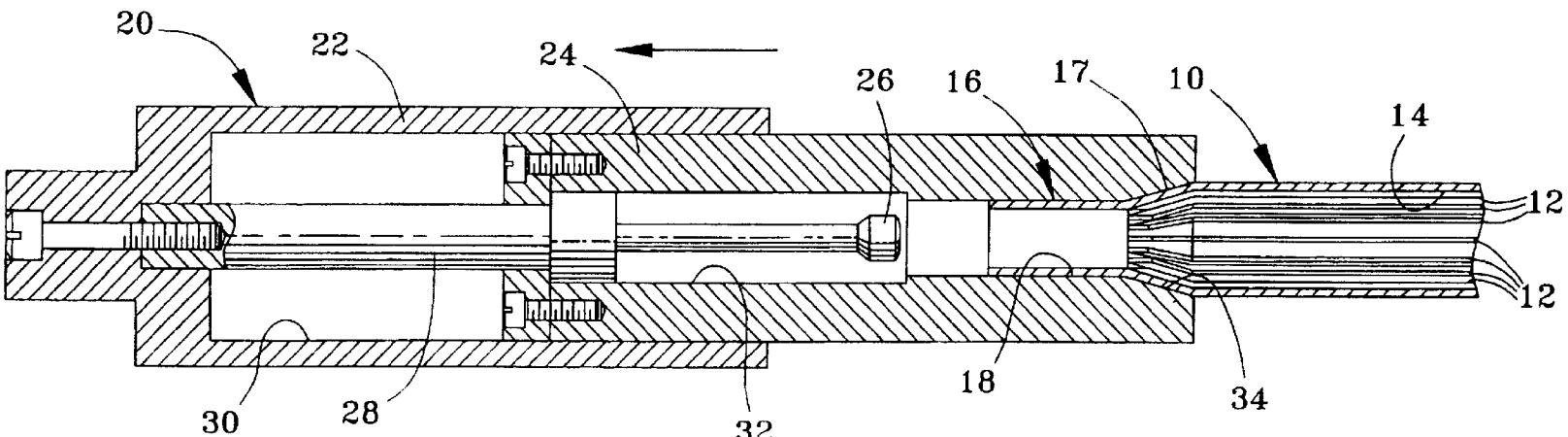
Figure 3:
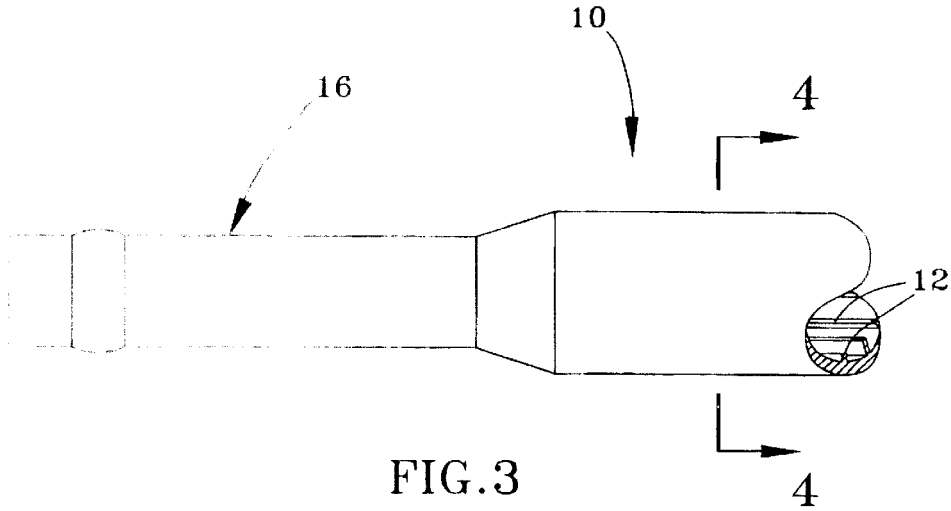
FIGS. 3 and 4 represent a tube of a type that can be end-formed in accordance with this invention.
Figure 4:
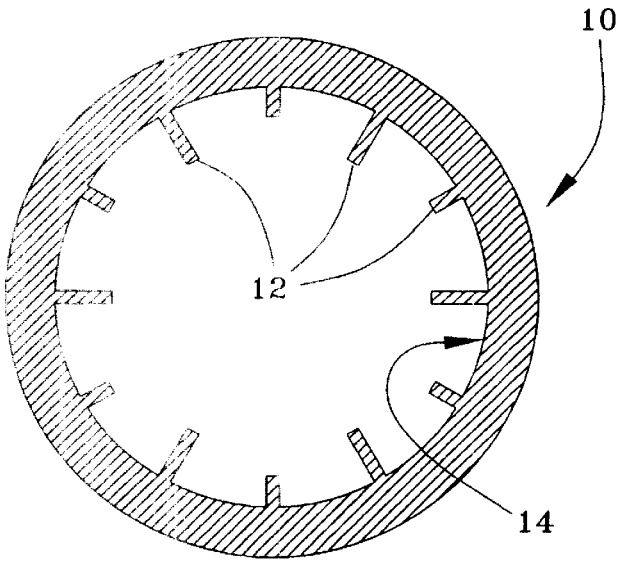

FIGS. 1 and 2 represent a process for performing an end-forming operation on a tube with one or more internal surface features, or enhancements. In FIGS. 1 and 2, the tube undergoing end-forming is represented as the heat exchanger tube 10 shown in FIGS. 3 and 4, though the invention also encompasses end-forming of tubes with internal surface features that differ from that shown in FIGS. 3 and 4.

FIGS. 1 and 2 represent the end 16 of the tube 10 as undergoing deformation with a tool 20 in accordance with a particular embodiment of the present invention. The tool 20 is shown as comprising a holder 22, an outer diameter (OD) die 24, and a mandrel 26. The mandrel 26 is located at one end of a shaft 28 secured within an internal bore 30 of the holder 22. The OD die 24 is tubular shaped and slidably received within the internal bore 30 of the holder 22. The OD die 24 has a stepped bore 32 within which the mandrel 26 is received. In this configuration, the position of the mandrel 26 relative to the holder 22 is fixed, while the position of the mandrel 26 relative to the die 24 varies as the die 24 is allowed to move within the holder 22, e.g., as the holder 22 is retracted in the direction of the arrow in FIG. 1.

The bore 32 of the die 24 is shown as defining an internal die cavity 18 having a chamfer 34 at its entrance. As evident from FIG. 1, the internal diameter of the die cavity 18 is less that the original outer diameter of the tube 10 (i.e., that portion of the tube 10 outside the die 24 in FIG. 1). Moving the tool 20 toward the tube 10 (or moving the tube 10 toward the tool 20) to force the die 24 over the tube end 16 causes the tube end 16 to be reduced in diameter as it passes through the chamfer 34 and into the die cavity 18, with a tapered shoulder 17 being defined between the reduced tube end 16 and the remainder of the tube 10 as represented in FIG. 1. Prior to initiating the end-forming operation represented in FIG. 1, the die 24 is retracted into the holder 22 so that the mandrel 26 is either circumscribed by the chamfer 34 (as shown in FIG. 1) or projects outside the bore 32. This positional relationship between the mandrel 26 and die 24 is maintained throughout the end-forming operation represented in FIG. 1, so that the mandrel 26 remains positioned interiorly of the tapered shoulder 17 produced on the tube 10 by the chamfer 34. The die 24 may be forced over the tube 10 until the tube 10 abuts the shaft 28. The entire reduction process portrayed in FIG. 1 can be performed in a single impact or multiple impacts.

As evident from FIG. 1, the mandrel 26 is preferably smaller in diameter than the enhancements 12 to be removed, and therefore does not alter the enhancements 12 during reduction of the tube end 16. However, FIG. 2 shows the mandrel 26 as having roughly the same diameter as the circumference 14 within the reduced end 16 of the tube 10, such that removal of the mandrel 26 through the reduced end 16 of the tube 10 necessarily results in at least partial elimination, and preferably complete elimination, of the enhancements 12 within the reduced end 16 of the tube 10.

FIG. 2 represents a second step of the end-forming process during which elimination of the enhancements 12 occurs. FIG. 2 illustrates the result of the holder 22 having been moved in the direction of the arrow, causing the mandrel 26 to also move in the direction of the arrow in view of the attachment of the shaft 28 to the holder 22. As the holder 22 and mandrel 26 move away from the tube 10, the die 24 is able to remain on the reduced tube end 16 as a result of the die 24 being reciprocably received in the bore 30 of the holder 22. In fact, the die 24 remains on the tube end 26 as a result of the inherent diametrical interference that exists between the die 24 and the tube end 16 following the reduction operation. As such, no additional means are required to retain the tube end 26 within the die cavity 18. The relative movement between the mandrel 26 and die 24 causes the mandrel 26 to be withdrawn from the tube end 16. As stated above, the mandrel 26 is sized so that the interior of the tube end 16 is deformed to the extent that the internal enhancements 12 within the reduced tube end 16 are flattened, preferably to the extent that all vestiges of the enhancements 12 are eliminated without removing any material from the tube 10. In so doing, the mandrel 26 simultaneously applies a radially-outward force on the wall of the tube end 16, causing an increase in friction between the die 24 and tube end 16 so that the tube end 16 remains within the die cavity 18 throughout withdrawal of the mandrel 26 through the tube end 16. During this process, the outer diameter of the tube end 16 remains constant as a result of being held within the die cavity 18.

While the invention has been described in terms of a specific embodiment, it is apparent that other forms could be adopted by one skilled in the art. For example, the tool 20 could differ in appearance and construction from the embodiment shown in the Figures. Accordingly, it should be understood that the invention is not limited to the specific embodiment illustrated in the Figures. It should also be understood that the phraseology and terminology employed above are for the purpose of disclosing the illustrated embodiments, and do not necessarily serve as limitations to the scope of the invention. Therefore, the scope of the invention is to be limited only by the following claims.

The invention claimed is:

1. A process of forming an end of a tube having at least one internal surface feature on an internal circumference of the tube and projecting into an internal passage defined by the tube, the process comprising the steps of:

moving an external die and a mandrel in unison so as to force the external die over the end of the tube and simultaneously insert the mandrel through the internal passage within the end of the tube, the external die reducing the outer diameter of the end of the tube so as to define a reduced-diameter portion at the end of the tube, the mandrel being positioned farther into the internal passage than the reduced-diameter portion of the tube; and then while the end of the tube remains within the external die, withdrawing the mandrel from the internal passage and through the reduced-diameter portion of the tube to eliminate at least a portion of the internal surface feature.

2. The process according to claim 1, wherein the portion of the internal surface feature is eliminated by deformation without physically removing from the tube the material defining the internal surface feature.

3. The process according to claim 1, wherein the external die and the mandrel are components of a tool assembly, the tool assembly further comprising a holder having a bore in which the external die is received and reciprocable in an axial direction of the bore, the mandrel is mounted within the tool assembly so as to be reciprocable relative to the external die, and the holder, the external die, and the mandrel move in unison during the moving step.

4. The process according to claim 3, wherein the mandrel is attached to the holder so as not to reciprocate relative to the holder during the moving and withdrawing steps.

5. The process according to claim 4, wherein the mandrel is reciprocably received in a bore defined by the external die, the mandrel moves in unison with the bore during the moving step, and the mandrel reciprocates within the bore during the withdrawing step.

6. The process according to claim 1, wherein the external die comprises a chamfer against which reduction of the end of the tube occurs during the moving step, and the mandrel is circumscribed by the chamfer during the moving step.

7. The process according to claim 1, wherein the mandrel does not interfere with the at least one internal surface feature within the end of the tube during the moving step.

8. The process according to claim 1, wherein the end of the tube remains within the external die during the withdrawing step solely as a result of interference between the die and the reduced-diameter portion of the tube.

9. The process according to claim 1, wherein the moving step is performed as a single impact between the external die and the end of the tube.

10. The process according to claim 1, wherein the moving step is performed as multiple impacts between the external die and the end of the tube.

11. The process according to claim 1, wherein the tube is a heat exchanger tube.

12. A process of forming an end of a heat exchanger tube having multiple internal enhancements on an internal circumference of the tube and projecting into an internal passage defined by internal circumference of the tube, the process comprising the steps of:

moving an external die and a mandrel in unison so as to force the external die over the end of the tube and simultaneously insert the mandrel through the internal passage within the end of the tube, the external die reducing the outer diameter of the end of the tube so as to define a reduced-diameter portion at the end of the tube, the mandrel being positioned farther into the internal passage than the reduced-diameter portion of the tube throughout the moving step; and then while the end of the tube remains within the external die, withdrawing the mandrel from the internal passage and through the reduced-diameter portion of the tube to eliminate the internal enhancements by deformation without physically removing from the tube the material defining the internal enhancements.

13. The process according to claim 12, wherein the external die and the mandrel are components of a tool assembly, the tool assembly further comprising a holder having a bore in which the external die is received and reciprocable in an axial direction of the bore, the mandrel is mounted within the tool assembly so as to be reciprocable relative to the external die, and the holder, the external die, and the mandrel move in unison during the moving step.

14. The process according to claim 13, wherein the mandrel is attached to the holder so as not to reciprocate relative to the holder during the moving and withdrawing steps.

15. The process according to claim 14, wherein the mandrel is reciprocably received in a bore defined by the external die, the mandrel moves in unison with the bore during the moving step, and the mandrel reciprocates within the bore during the withdrawing step.

16. The process according to claim 15, wherein the end of the tube remains within the external die at the initiation of the withdrawing step solely as a result of interference between the die and the reduced-diameter portion of the tube, and the mandrel forces the reduced-diameter portion of the tube into greater contact with the die as the mandrel is withdrawn through the reduced-diameter portion of the tube so that the end of the tube remains within the die throughout the withdrawing step.

17. The process according to claim 12, wherein the external die comprises a chamfer against which reduction of the end of the tube occurs during the moving forcing step, and the mandrel is circumscribed by the chamfer during the moving step.

18. The process according to claim 12, wherein the mandrel does not interfere with the internal enhancements within the end of the tube during the moving step.

19. The process according to claim 12, wherein the moving step is performed as a single impact between the external die and the end of the tube.

20. The process according to claim 12, wherein the moving step is performed as multiple impacts between the external die and the end of the tube.

* * * * *